US006464076B2

(12) United States Patent
Tan

(10) Patent No.: US 6,464,076 B2
(45) Date of Patent: Oct. 15, 2002

(54) GOLF CLUB POSITIONING BOTTOM RACK FOR GOLF BAG

(76) Inventor: Fu-Hsing Tan, 4th. Fl., 101-1, Chi Lin Road, Yang Chou Tsun, Lu Chu, Taoyuan Hsien (TW)

( * ) Notice: Subject to any disclaimer, the term of this patent is extended or adjusted under 35 U.S.C. 154(b) by 0 days.

(21) Appl. No.: 09/788,377

(22) Filed: Feb. 21, 2001

(65) Prior Publication Data

US 2002/0115495 A1 Aug. 22, 2002

(51) Int. Cl.[7] ..... A63B 55/04

(52) U.S. Cl. ..... 206/315.6; 206/315.2; 211/70.2

(58) Field of Search ..... 206/315.6, 315.2, 206/315.3, 315.4, 315.8; 211/70.2, 70.5, 60.1, 69.5; 280/DIG. 5, DIG. 6

(56) References Cited

U.S. PATENT DOCUMENTS 4,753,446 A * 6/1988 Mills ..... 206/315.6
4,852,896 A * 8/1989 Mills ..... 206/315.2
4,915,221 A * 4/1990 Spangler ..... 206/315.3
5,029,703 A * 7/1991 Dulyea ..... 206/315.3
5,135,107 A * 8/1992 Ingraham ..... 206/315.2
5,732,819 A * 3/1998 Nishimura et al. ..... 206/315.3
6,102,202 A * 9/2000 Jones ..... 206/315.6

* cited by examiner

*Primary Examiner*—Lee Young
*Assistant Examiner*—Lien Ngo
(74) *Attorney, Agent, or Firm*—Troxell Law Office PLLC

(57) ABSTRACT

A golf club bottom positioning rack made of foam material and fastened to the inside of the bottom cuff of a golf bag and adapted to hold golf clubs in the golf bag. The golf club bottom positioning rack having at least two vertically spaced decks, each deck having rows of insertion holes and engagement fins at two sides of each insertion hole. The insertion holes of the decks are respectively vertically aligned for receiving the grips of golf clubs being inserted into the golf bag. The diameter of the insertion holes of a lower deck is greater than the diameter of the insertion holes of an upper deck.

5 Claims, 4 Drawing Sheets

GOLF CLUB POSITIONING BOTTOM RACK FOR GOLF BAG

BACKGROUND OF THE INVENTION

The present invention relates to a golf bag and, more specifically, to a golf club positioning bottom rack for use in a golf bag to hold golf clubs in place, which provides a friction force with the grip of each golf club inserted therein, keeping each inserted golf club positively secured in place.

A golf bag is used for carrying golf clubs including putters, iron clubs and wooden clubs. When moving or tilting a golf bag or putting it on the ground, the loaded golf clubs may be forced to hit one against another, causing a damage to the surface of the shaft of each golf club. In order to eliminate this problem, positioning means shall be used to hold golf clubs in the golf bag in good order.

SUMMARY OF THE INVENTION

The invention has been accomplished under the circumstances in view. It is the main object of the present invention to provide a golf club positioning bottom rack for golf bag, which provides a friction force with the grip of each golf club inserted therein, keeping each inserted golf club positively secured in place in the golf bag. According to one aspect of the present invention, the golf club bottom positioning rack is made of foam material and fastened to the inside of the bottom cuff of a golf bag and adapted to hold golf clubs in the golf bag. The golf club bottom positioning rack comprises at least two vertically spaced decks, each deck having rows of insertion holes. The insertion holes of the decks are respectively vertically aligned for receiving the grips of golf clubs being inserted into the golf bag. The diameter of the insertion holes of a lower deck is greater than the diameter of the insertion holes of an upper deck. According to another aspect of the present invention, each deck comprises a plurality of horizontal splits respectively extended from two opposite sides of each insertion holes and defining a plurality of engagement fins for engaging the peripheral wall of the grip of each golf club being inserted into the golf bag.

DETAILED DESCRIPTION OF THE PREFERRED EMBODIMENT

Figure 1:
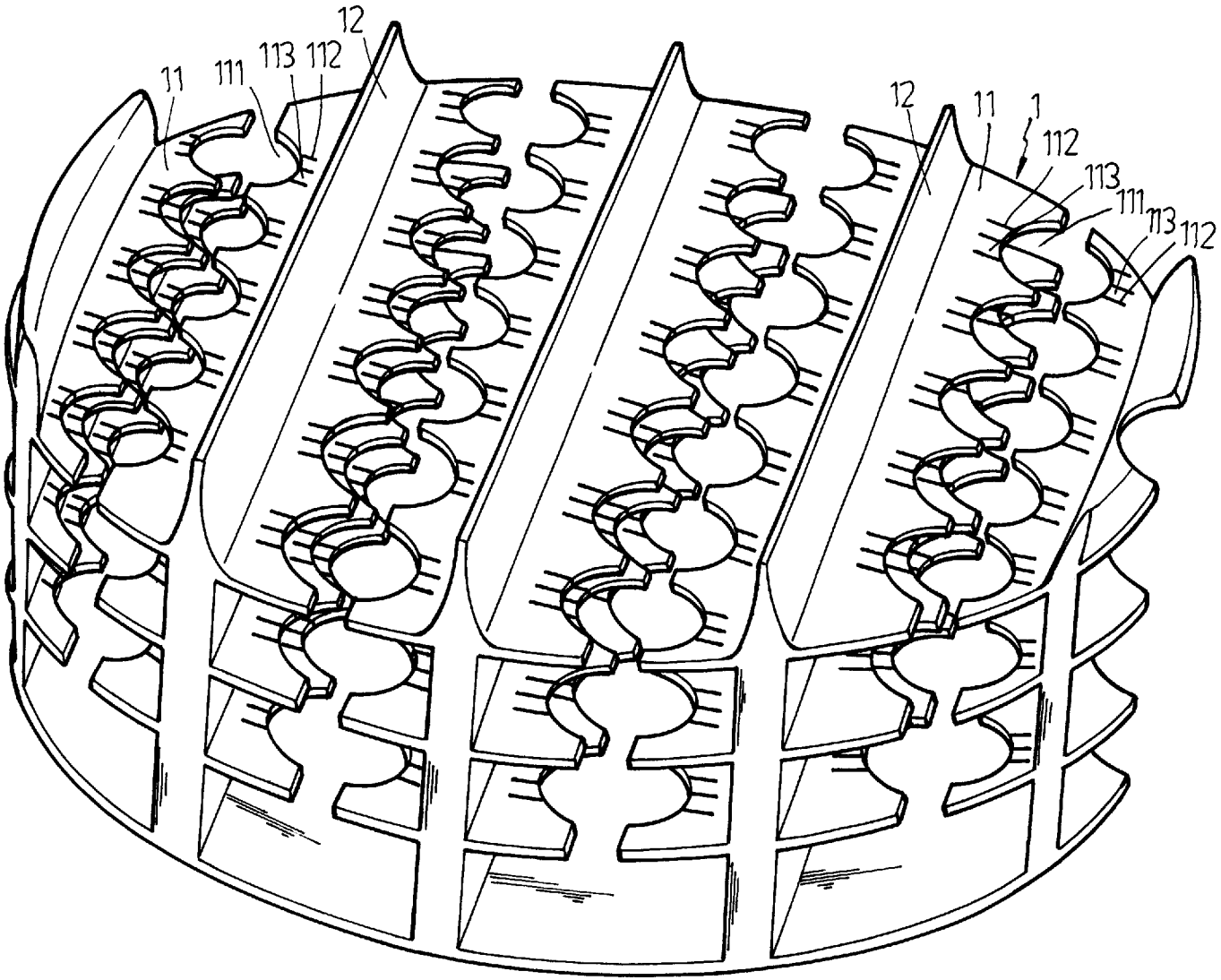
FIG. 1 is a perspective view of a golf club positioning bottom rack for golf bag according to the present invention.

Referring to FIGS. from 1 through 4, a golf club positioning bottom rack 1 is fixedly fastened to the inside of the bottom cuff of a golf bag 3 and adapted to hold golf clubs in the golf bag 3 in good order. The golf club positioning bottom rack 1 is molded from foam material comprising at least two vertically spaced decks 11. Each deck 11 comprises multiple rows of insertion holes 111. The insertion holes 111 of the decks 11 are respectively vertically aligned. However, the diameter of the insertion holes 111 of a lower deck 11 is relatively greater than the diameter of the insertion holes 111 of an upper deck 11, so as to fit the shape of the grip 21 of a golf club 2. Each deck 11 further comprises a plurality of horizontal splits 112 respectively extended from two opposite sides of each insertion hole 111, defining a plurality of engagement fins 113 for engaging the peripheral wall of the grip 21 of each golf club 2 inserted therein. Because the golf club positioning bottom rack 1 is made of flexible material, it does not scratch the surface of the golf club 2 inserted therein.

Figure 2:
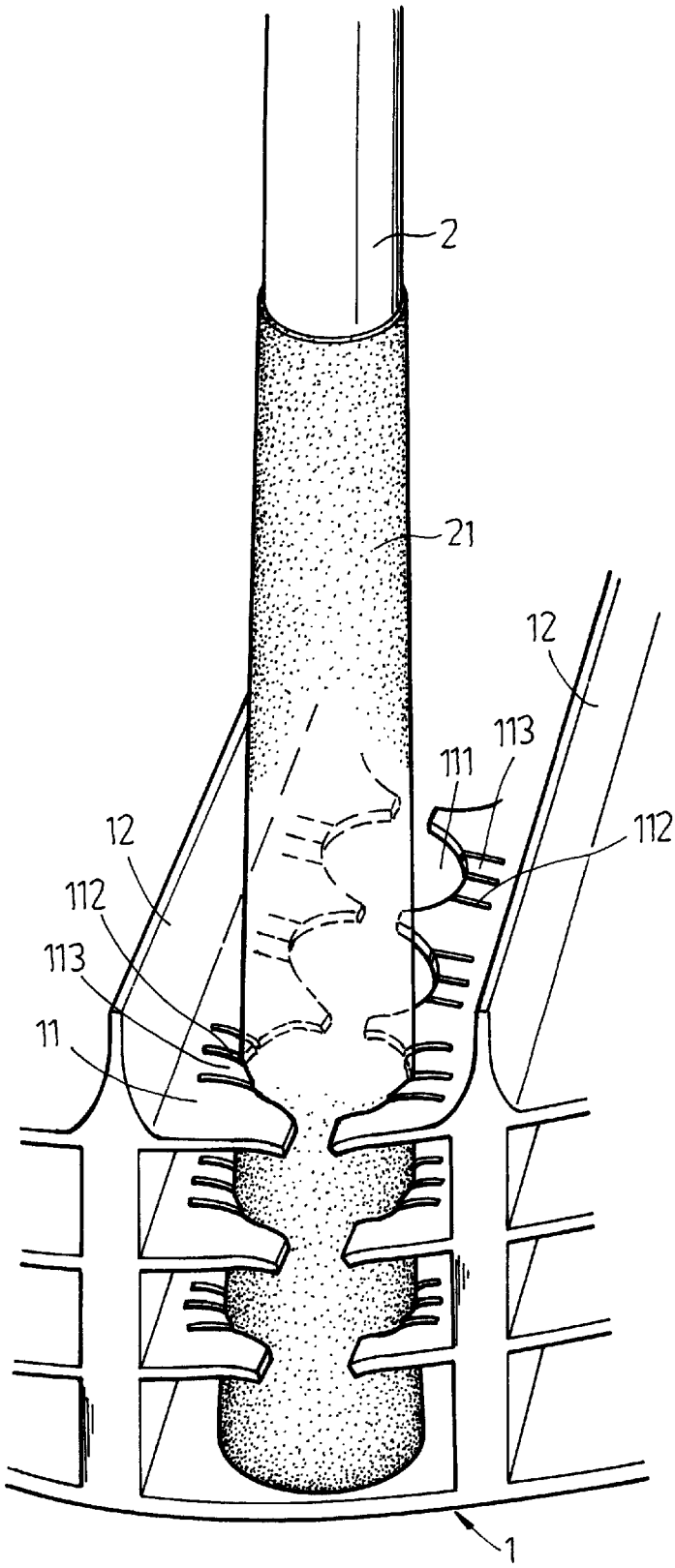
FIG. 2 is a perspective view of a part of the present invention, showing a golf club fastened to the golf club positioning bottom rack.
Figure 3:
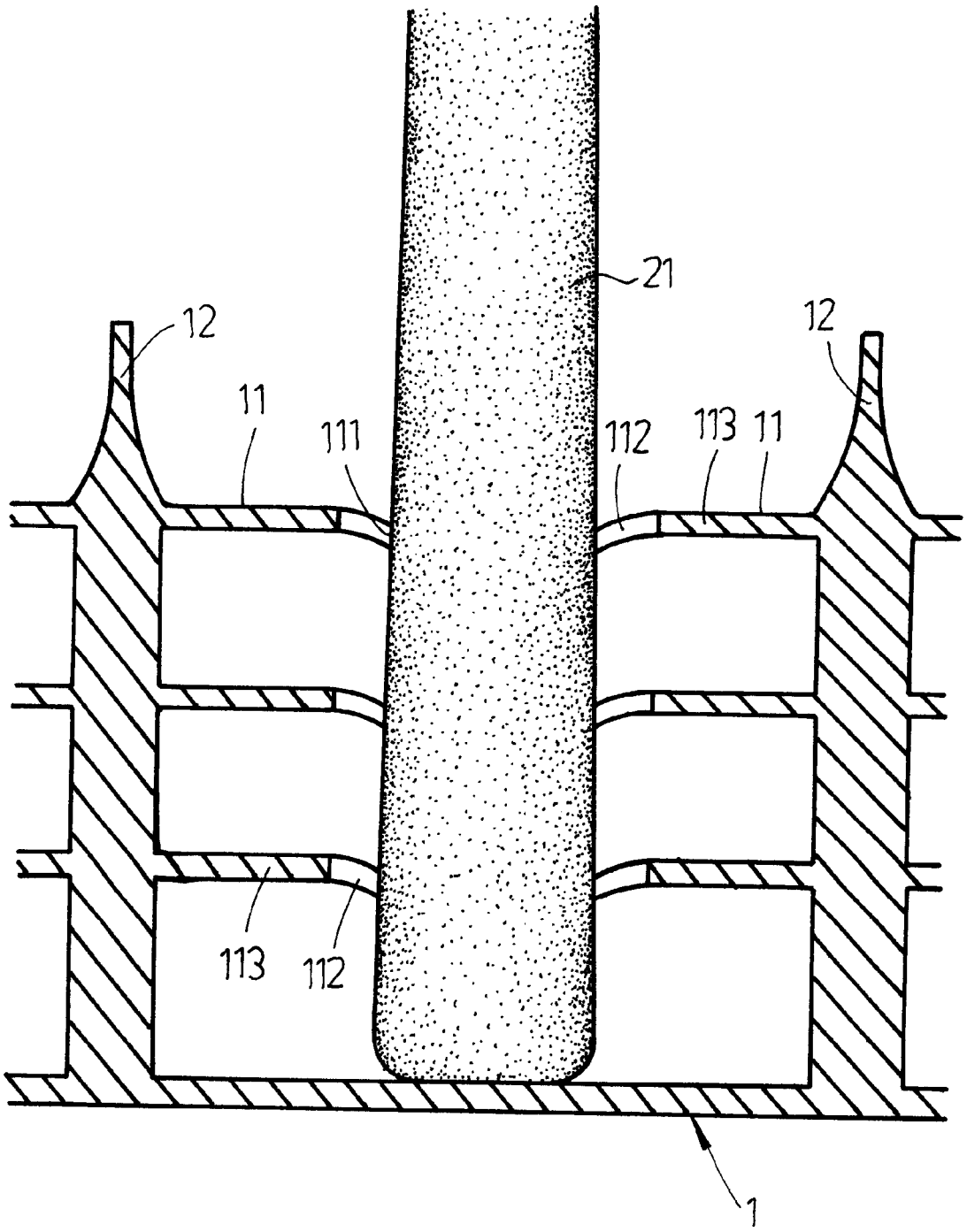
FIG. 3 is a side plain view of FIG. 2.

Referring to FIGS. 2 and 3 again, the diameters of the insertion holes 111 are smaller than the grip 21 of the golf club 2, the grip 21 of the golf club 2 is positively secured in place after inserted into one line of vertically aligned insertion holes 111 in the golf club positioning bottom rack 1. After insertion of the grip 21 into one line of vertically aligned insertion holes 111 in the golf club positioning bottom rack 1, the respective engagement fins 113 are deformed and curved downwards to produce a friction resistance with the grip 21, keeping the grip 21 of the inserted golf club 2 positively secured in place. Further, the golf club positioning bottom rack 1 is used with a golf club top positioning rack (not shown), which is fastened to the inside of the top cuff of the golf gag 3, so that inserted golf clubs are kept in good order.

Figure 4:
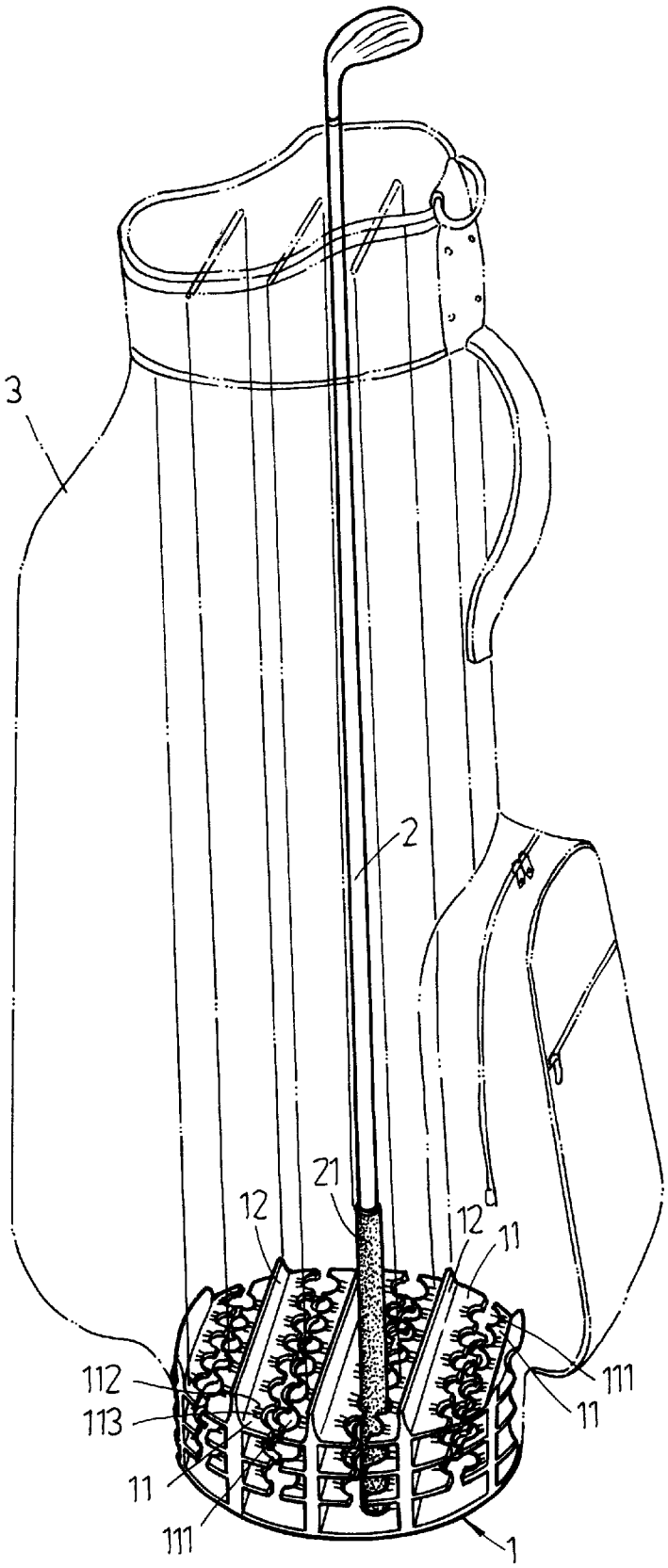
FIG. 4 is an applied view of the present invention, showing the golf club positioning bottom rack installed in a golf bag.

Referring to FIG. 4 again, partition plates 12 are formed integral with the decks 11 to separate the rows of insertion holes 11. The partition plates 12 can be upwardly extended to the top cuff of the golf bag 3. In this case, a golf club top positioning rack is not necessary.

It is to be understood that the drawings are designed for purposes of illustration only, and are not intended for use as a definition of the limits and scope of the invention disclosed.

What the invention claimed is:

1. A positioning rack configured to be fastened to an inside of a bottom cuff of a golf bag, and comprising:

a) at least two vertically spaced apart decks, each deck having a plurality of rows of insertion holes, the insertion holes of one deck being aligned with the insertion holes of an adjacent deck, diameters of the insertion holes increasing in a direction from an uppermost deck to a lowermost deck;

b) a plurality of elongated partition plates connecting the at least two vertically spaced apart decks, the partition plates extending between adjacent rows of insertion holes; and, c) a plurality of horizontal slits extending from two opposite sides of each insertion hole forming a plurality of deformable engagement fins, all the engagement fins located so as to engage grip portions of golf clubs inserted into the insertion holes.

2. The positioning rack of claim 1 wherein the plurality of elongated positioning plates are formed integrally with the at least two spaced apart decks.

3. The positioning rack of claim 2 wherein the plurality of elongated positioning plates and the at least two spaced apart decks are made of a foam material.

4. The positioning rack of claim 1 wherein the at least two spaced apart decks and the plurality of elongated positioning plates are made of flexible material.

5. The positioning rack of claim 1 further comprising three vertically spaced apart decks.

* * * * *